US007111914B2

(12) United States Patent
Avendano

(10) Patent No.: US 7,111,914 B2
(45) Date of Patent: Sep. 26, 2006

(54) TILT-OUT AND PICK-OFF BASKET ASSEMBLY FOR A REFRIGERATOR DOOR

(75) Inventor: Jose G. Avendano, Coal Valley, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,608

(22) Filed: Mar. 12, 2003

(65) Prior Publication Data

US 2004/0178711 A1 Sep. 16, 2004

(51) Int. Cl.
*E06B 1/00* (2006.01)
*A47B 88/00* (2006.01)
*A47B 96/04* (2006.01)

(52) U.S. Cl. ..... 312/405.1; 312/321.5; 312/328

(58) Field of Classification Search ..... 312/404, 312/405.1, 321.5, 327, 328; 108/108, 110; 211/80

See application file for complete search history.

(56) References Cited

U.S. PATENT DOCUMENTS 2,012,262 A 8/1935 Forsthoefel
2,062,360 A 12/1936 Goulooze
2,155,967 A 4/1939 Carroll
2,381,598 A 8/1945 Jones
3,625,371 A 12/1971 Dill
4,186,978 A 2/1980 Thomson
5,375,924 A 12/1994 Pohl et al.
5,513,910 A 5/1996 Ellingwood et al.
5,567,029 A 10/1996 Haenisch et al.
6,074,030 A 6/2000 Prunty et al.
6,439,400 B1 * 8/2002 Battaglia et al. ..... 211/59.2
6,439,401 B1 * 8/2002 Battaglia et al. ..... 211/59.2
6,701,570 B1 * 3/2004 Henriott et al. ..... 16/29
2003/0020386 A1 1/2003 Leimkuehler et al.
2003/0080661 A1 5/2003 Ahmed et al.
2003/0102787 A1 6/2003 Whitaker et al.

* cited by examiner

*Primary Examiner*—Peter M. Cuomo
*Assistant Examiner*—Sarah B. McPartlin
(74) *Attorney, Agent, or Firm*—Diederiks & Whitelaw, PLC

(57) ABSTRACT

A combination tilt-out and pick-off basket assembly for storing items on a door of a refrigerator includes a coated wire basket pivotally attached to a molded plastic basket frame. Pivot shafts on the basket snap-fittingly engage apertures in the basket frame and allow the basket to move between a retracted position, wherein the basket is substantially recessed within the basket frame, and a tilt-out position, wherein a substantial body portion of the basket is exposed outside the basket frame. A stop member is provided for limiting the degree to which the basket can pivot relative to the basket frame. Mounting members formed in the basket frame allow the assembly to be removably supported on mounting supports on a freezer or fresh food compartment door liner.

23 Claims, 3 Drawing Sheets

TILT-OUT AND PICK-OFF BASKET ASSEMBLY FOR A REFRIGERATOR DOOR

BACKGROUND OF THE INVENTION

1. Field of the Invention

The present invention pertains to the art of refrigerators and, more particularly, to a storage unit in a refrigerator. The refrigerator storage unit of the invention takes the form of a tilt-out and pick-off basket assembly which is particularly useful in a refrigerator freezer compartment, but can also be used in a refrigerator fresh food compartment.

2. Discussion of the Prior Art

It is known to provide the inner portion of a refrigerator door with removable trays or bins for the storage of food products. It is also known, as demonstrated by U.S. Pat. No. 5,375,924, to provide mounting supports or ribs on a refrigerator door liner for mounting removable storage units in a refrigerator. Readily removable storage units enable a consumer to maximize the use of available storage space in a refrigerator by positioning storage units in a manner that best accommodates a variety of food items. Although useful from an organizational standpoint, the retaining walls on these types of storage units may not adequately retain food items when the refrigerator door is being opened or shut. Additionally, the higher the retaining wall, the more the view of the food items is obstructed.

Another known type of storage unit constitutes a pull-out type storage basket which pivotally connects to a refrigerator door liner. Such a basket is disclosed in U.S. Pat. No. 5,513,910. This type of storage unit has the advantage of retaining food items while providing a relatively unobstructed view of and easy access to food items. However, the is specific structure required for connecting the pivoting basket to a refrigerator door liner prevents the basket from being removable and interchangeable with other types of storage units.

One solution to this problem is addressed in U.S. Pat. No. 5,567,029. More specifically, the storage unit disclosed in the '029 patent is in the form of a removable shelf unit with a built-in retaining member. This arrangement prevents items placed upon the shelves from falling off due to abrupt movements of the refrigerator door, while also allowing a consumer to positioning the shelf unit in a manner that best accommodates various food items.

Regardless of these known arrangements, there is considered to exist a need in the art for a new type of removable storage unit that allows consumers to further enhance the utilization of available storage space on a refrigerator door, and that securely retains food items while providing easy access to and an unobstructed view of the items.

SUMMARY OF THE INVENTION

The present invention is directed to a combination tilt-out and pick-off basket assembly for a refrigerator door. The basket assembly includes a coated wire formed basket attached to a molded plastic basket frame in a manner that allows movement of the basket between a retracted position, wherein the basket is substantially recessed within the basket frame, and a tilt-out position, wherein a substantial body portion of the basket is exposed outside the basket frame. This pivoting arrangement is achieved by snap-fitting a pivot shaft carried by the basket into an aperture in the basket frame. Preferably, the assembly includes a stop means to limit a permissible degree of pivoting of the basket relative to the basket frame. The basket frame is formed with mounting members that allow the assembly to be removably supported on vacuum formed mounting supports of a refrigerator door liner.

With this arrangement, a versatile, space efficient, and readily removable storage unit for a refrigerator is provided which allows secure retention of and easy access to food items stored therein. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
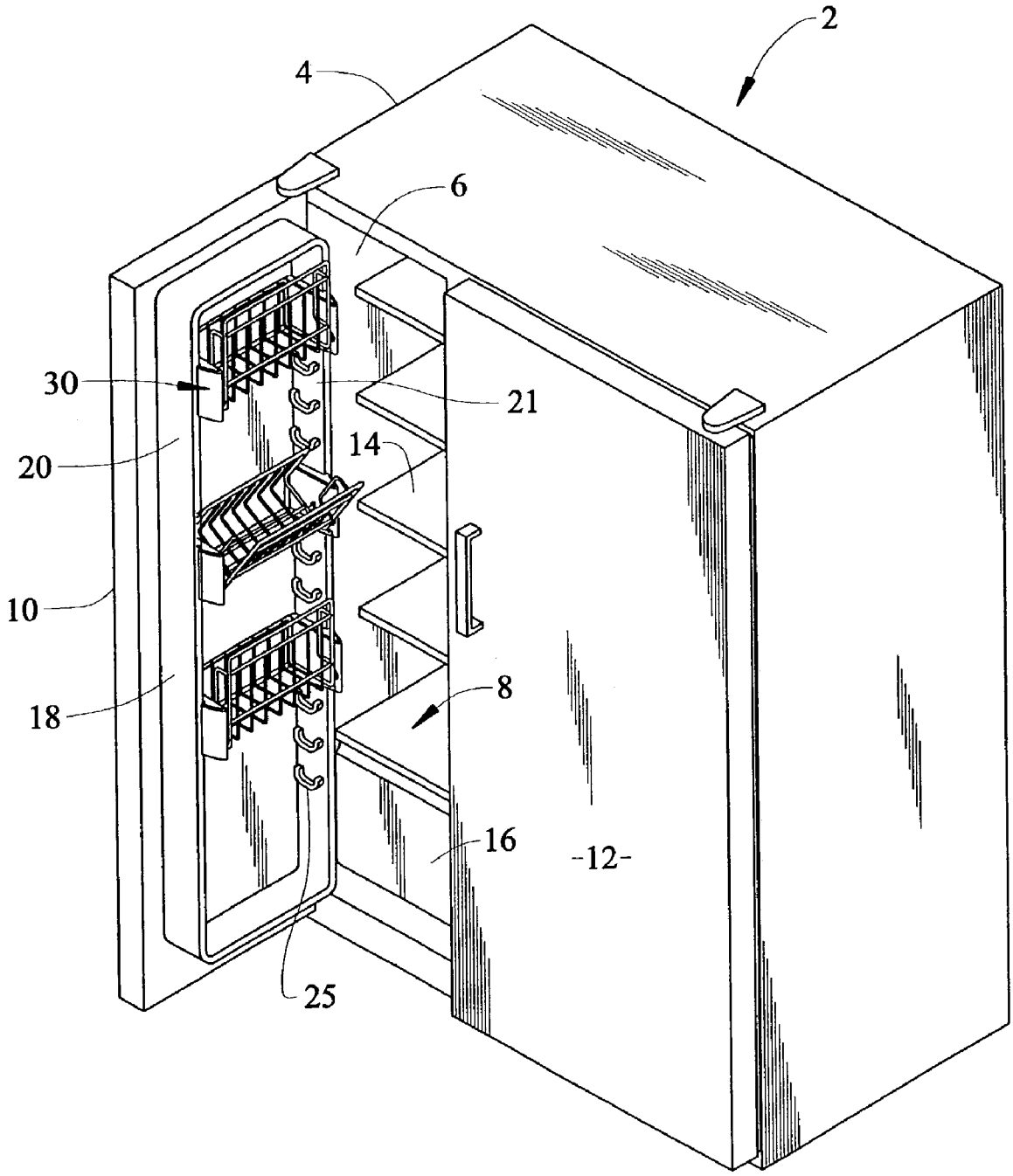
FIG. 1 is a perspective view of a side-by-side refrigerator including a plurality of tilt-out and pick-off basket assemblies constructed in accordance with the present invention mounted on a freezer door of the refrigerator.

With initial reference to FIG. 1, a side-by-side refrigerator 2 includes a cabinet shell 4 within which is positioned a liner 6 that defines a freezer compartment 8. In a manner known in the art, freezer compartment 8 can be accessed by the selective opening of a freezer door 10. In a similar manner, a fresh food door 12 can be opened to access a liner defined fresh food compartment (not shown). As illustrated in FIG. 1, freezer compartment 8 is provided with a plurality of vertically spaced shelves 14, along with a slidably mounted bin 16. Also illustrated is a freezer door liner 18 including dike portions 20 and 21 formed with vertically spaced mounting supports 25. In general, the basic structure of refrigerator 2 described above is known in the art and presented only for the sake of completeness. However, at this point, it should be realized that refrigerator 2 can take various forms known in the art without departing from the present invention as will be realized more fully below in discussing specific aspects of the invention.

Figure 2:
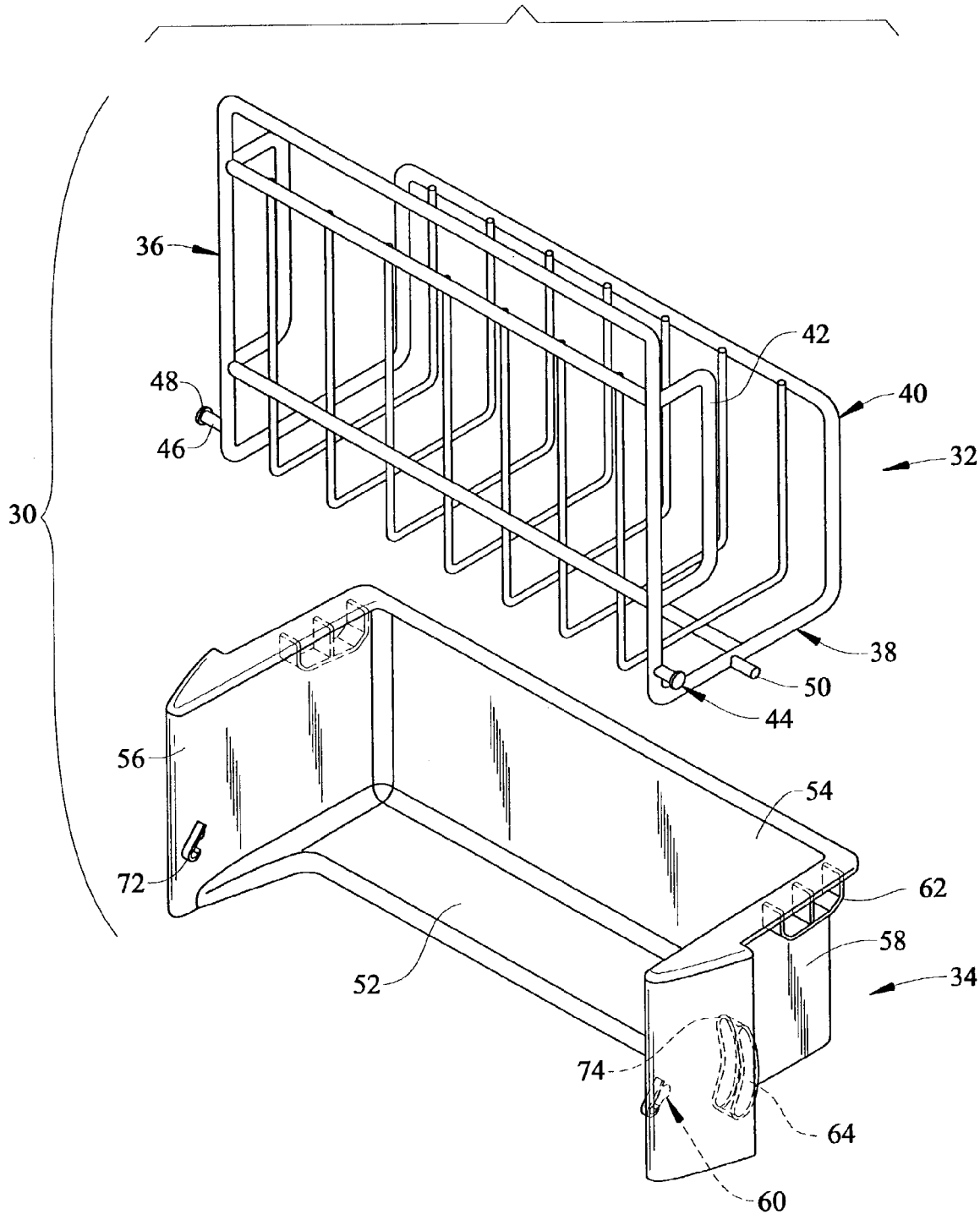
FIG. 2 is an enlarged exploded view of the tilt-out and pick-off basket assembly of the present invention.

The present invention is particularly directed to a combination tilt-out and pick-off basket assembly indicated at 30. Although FIG. 1 illustrates three such basket assemblies 30, it should be realized that the actual number of basket assemblies 30 can be readily varied. As depicted in FIG. 2, basket assembly 30 constructed in accordance with the preferred embodiment of the invention includes a basket 32 and a basket frame 34. Basket 32 is preferably made from elastomeric coated wire and includes a front wall portion 36, a bottom wall portion 38, a back wall portion 40, and two end guard portions 42. End guard portions 42 are laterally spaced and project at an approximate 90° angle from front wall portion 36 toward back wall portion 40. Basket 32 also includes a pair outwardly projecting pivot shafts 44. Pivot shafts 44 are laterally spaced and project from lower ends of front wall portion 36. As depicted, each pivot shaft 44 includes a shaft portion 46 and an enlarged head portion 48. Preferably, basket 32 includes at least one stop element 50 projecting laterally from bottom wall portion 38.

In the preferred embodiment shown, basket frame 34 is constituted by an integral, injection molded plastic piece that includes a bottom wall 52, a back wall 54, and two side walls 56 and 58. Each of the opposing side walls 56 and 58 includes a laterally opening aperture 60 and at least one mounting member 62. Additionally, an arcuate track 64 is formed in at least one of side walls 56 and 58. Mounting members 62 are formed to matingly engage mounting supports 25 on freezer door liner 18 for securing basket assembly 30 to freezer door liner 18. This arrangement allows basket assembly 30 to be readily picked-off freezer door liner 18, while also functioning to selectively retain basket assembly 30 on mounting supports 25 during regular use of basket assembly 30.

Figure 3:
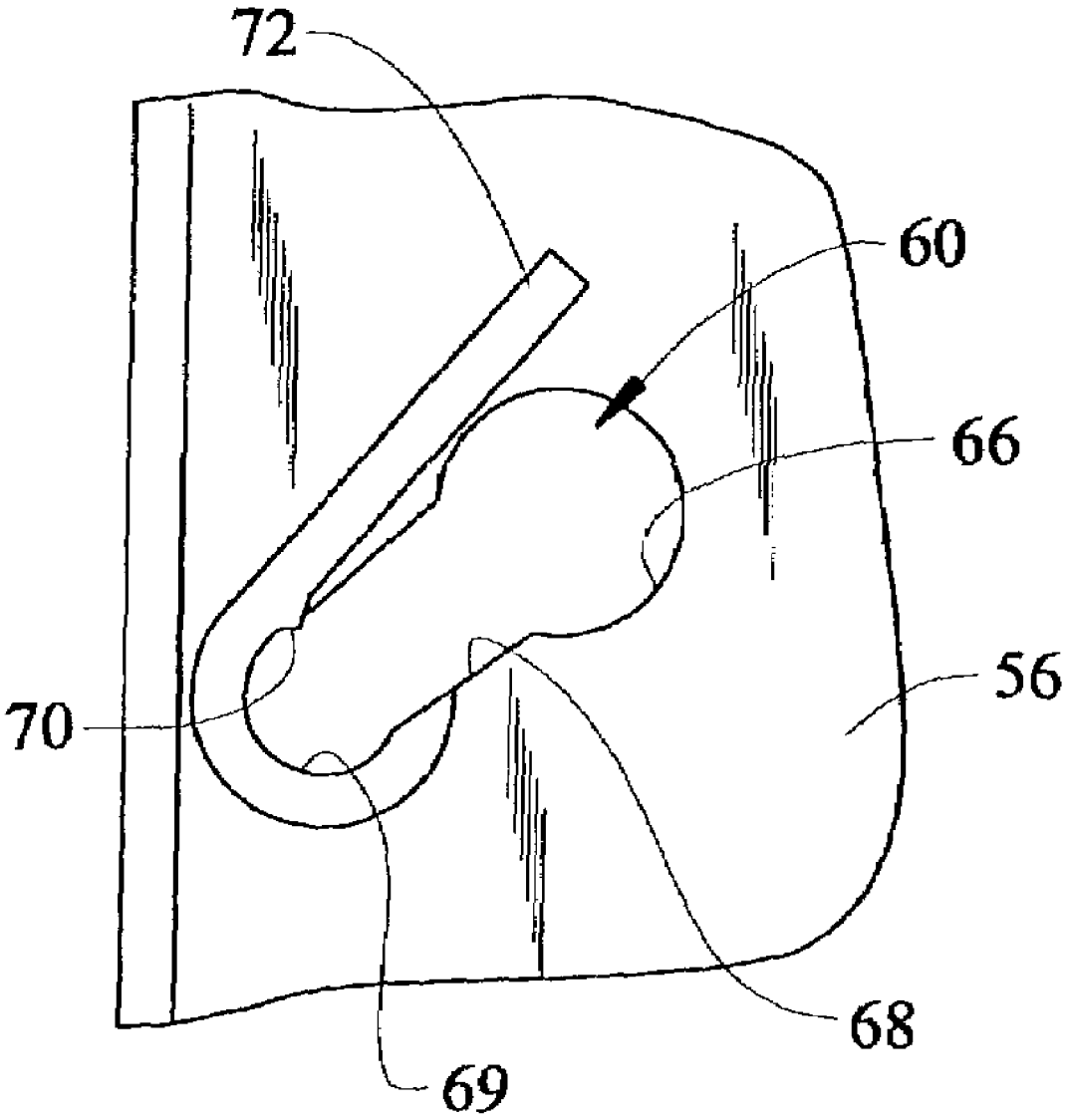
FIG. 3 is a partial, elevational view of a side wall of the basket assembly of FIGS. 1 and 2.

Basket 32 is attached to basket frame 34 in a manner which allows movement of basket 32 between a retracted position, wherein basket 32 is substantially recessed within basket frame 34 (see uppermost and lowermost basket assemblies 30 in FIG. 1), and a tilt-out position, wherein a substantial body portion of basket 32 is exposed outside basket frame 34 (see intermediate basket assembly 30 in FIG. 1). This pivoting arrangement is achieved by fitting pivot shafts 44 of basket 32 into lateral opening apertures 60 of basket frame 34. In the preferred embodiment, the pivot shafts 44 are snap-fittingly received into lateral opening apertures 60. More specifically, as best shown in FIG. 3, each laterally opening aperture 60 includes an enlarged opening 66 which leads to a narrow, slotted portion 68, and finally a terminal opening 69. Each slotted portion 68 is partially defined by an inwardly extending projection 70 of a guide element 72. Guide element 72 preferably has a hook-shape and helps guide enlarged head 48 of pivot shaft 44 into aperture 60, where pivot shaft 44 is pushed past projection 70 so as to be snap-fittingly received in at terminal opening 69. With this arrangement, enlarged head portion 48 is arranged behind a respective side wall 56, 58 and maintains pivot shaft 44 in aperture 60 so as to prevent basket 32 from being unintentionally disengaged from basket frame 34. In addition, guide elements 72 provide additional supporting surface for pivot shafts 44.

When mounting basket 32 within basket frame 34, stop element 50 is also received in track 64. Based thereon, as basket 32 is pivoted about an axis defined by shafts 44 from a recessed position within basket frame 34 to a tilt-out position, stop element 50 is guided along track 64 until it abuts a terminal end 74 of track 64, thus limiting the permissible degree to which basket 32 can pivot relative to basket frame 34.

Although described with reference to a preferred embodiment of the invention, it should be readily understood that various changes and/or modifications can be made to the invention without departing from the spirit thereof. However, it should be realized that basket assembly 30 of the present invention advantageously defines a storage unit for a refrigerator door wherein food items can be conveniently stored/loaded and readily accessed. Particularly, the invention enables the stored food items to be removed from or supported within basket 32 by either pivoting basket 32 relative to frame 34 between predefined recessed and tilt-out positions or completely removing basket assembly 30 from upon the door 10. In general, the invention is only intended to be limited by the scope of the following claims.

I claim:

1. In a refrigerator having a door including an outer panel and an inner liner, a combination tilt-out and pick-off basket assembly for holding articles for refrigeration comprising:

a basket frame including a bottom wall, opposing side walls, and at least two mounting members, each of the opposing side walls being provided with a laterally opening aperture, said basket frame being removably supported on the inner liner through the mounting members in a manner which enables the entire basket frame to be readily picked-off the inner liner, a basket including a front wall portion, a bottom wall portion, a back wall portion and a pair of laterally outwardly projecting pivot shafts, said pivot shafts being snap-fittingly mounted within the laterally opening apertures such that the basket is pivotally attached to the basket frame for movement between a retracted position, wherein the basket is substantially recessed within the basket frame, and a tilt-out position, wherein a substantial body portion of the basket is exposed outside the basket frame to enhance access to articles stored in the basket; and stop means for limiting a permissible degree of pivoting of the basket relative to the basket frame, said stop means including a track, provided in the basket frame, and a stop element extending from the basket, said track including first and second end walls, wherein the stop element projects into the track and, upon pivoting of the basket relative to the basket frame, abuts one of the first and second end walls to limit a degree of pivoting of the basket relative to the basket frame.

2. In a refrigerator having a door including an outer panel and an inner liner, a combination tilt-out and pick-off basket assembly for holding articles for refrigeration comprising:

a basket frame including a bottom wall, opposing side walls, and at least two mounting members, said basket frame being removably supported on the inner liner through the mounting members in a manner which enables the entire basket frame to be readily picked-off the inner liner; a basket including a front wall portion, a bottom wall portion, and a back wall portion, said basket being pivotally attached to the basket frame for movement between a refracted position, wherein the basket is substantially recessed within the basket frame, and a tilt-out position, wherein a substantial body portion of the basket is exposed outside the basket frame to enhance access to articles stored in the basket; and stop means for limiting a permissible degree of pivoting of the basket relative to the basket frame, said stop means including a track, provided in the basket frame, and a stop element extending from the basket, said track including first and second end walls, wherein the stop element projects into the track and, upon pivoting of the basket relative to the basket frame, abuts one of the first and second end walls to limit a degree of pivoting of the basket relative to the basket frame.

3. The combination tilt-out and pick-off basket assembly according to claim 2, wherein each of the opposing side walls of the basket frame is provided wit a laterally opening aperture and the basket includes a pair of laterally outwardly projecting pivot shafts, said pivot shafts being mounted within the laterally opening apertures to pivotally attach the basket to the basket frame.

4. The combination tilt-out and pick-off basket assembly according to claim 3, wherein each of the apertures includes an enlarged opening leading to a narrow, slotted portion.

5. The combination tilt-out and pick-off basket assembly according to claim 4, wherein each slotted portion is defined, at least in part, by an inwardly extending projection, wherein each pivot shaft is snap-fittingly received past the projection in a respective one of the apertures.

6. The combination tilt-out and pick-off basket assembly according to claim 3, wherein each of the pivot shafts includes a shaft portion and an enlarged head portion.

7. The combination tilt-out and pick-off basket assembly according to claim 3, further comprising: a pair of guide projections extending from the opposing side walls of the basket frame, said guide projections encompassing portions of the apertures.

8. The combination tilt-out and pick-off basket assembly according to claim 7, wherein each of the guide projections is generally hook-shaped.

9. The combination tilt-out and pick-off basket assembly according to claim 2, wherein the stop element projects from the bottom wall portion or the basket and the track is formed in one of the opposing side walls of the basket frame.

10. The combination tilt-out and pick-off basket assembly according to claim 9, wherein the stop element is located closer to the front wall portion than the back wall portion of the basket.

11. The combination tilt-out and pick-off basket assembly according to claim 10, wherein the basket constitutes a wire basket.

12. The combination tilt-out and pick-off basket assembly according to claim 2, further comprising: a pair of laterally spaced end guards projecting from the front wall portion toward the back wall portion of the basket.

13. In a refrigerator having a door including an outer panel and an inner liner, a combination tilt-out and pick-off basket assembly for holding articles for refrigeration comprising:

a basket frame including a bottom wall, opposing side walls, and at least two mounting members, each of the opposing side walls being provided with a laterally opening aperture, said basket frame being removably supported on the inner liner through the mounting members in a manner which enables the entire basket frame to be readily picked-off the inner liner;

a basket including a front wall portion, a bottom wall portion, a back wall portion and a pair of laterally outwardly projecting pivot shafts said front wall portion being spaced from the back wall portion by the bottom wall portion in a manner which enables articles to be supported by the bottom wall portion between the front and back wall portions. said pivot shafts being snap-fittingly mounted within the laterally opening apertures such tat the basket is pivotally attached to the basket frame for movement between a retracted position, wherein the basket is substantially recessed within the basket frame, and a hit-out position, wherein a substantial body portion of the basket is exposed outside the basket frame to enhance access to articles stored in the basket; and stop means for limiting a permissible degree of pivoting of the basket relative to the basket frame.

14. The combination tilt-out and pick-off basket assembly according to claim 13, wherein each of the apertures includes an enlarged opening leading to a narrow, slotted portion.

15. The combination tilt-out and pick-off basket assembly according to claim 14, wherein each slotted portion is defined, at least in part, by an inwardly extending projection, wherein each pivot shaft is snap-fittingly received past the projection in a respective one of the apertures.

16. The combination tilt-out and pick-off basket assembly according to claim 13, wherein each of the pivot shafts includes a shaft portion and an enlarged head portion.

17. The combination tilt-out and pick-off basket assembly according to claim 13, further comprising: a pair of guide projections extending from the opposing side walls of the basket frame, said guide projections encompassing portions of the apertures.

18. The combination tilt-out and pick-off basket assembly according to claim 17, wherein each of the guide projections is generally hook-shaped.

19. The combination tilt-out and pick-off basket assembly according to claim 13, wherein said stop means includes a track, provided in one of opposing side walls of the basket frame, and a stop element extending from the basket, said track including first and second end walls, wherein the stop element projects into the track and, upon pivoting of the basket relative to the basket frame, abuts one of the first and second end walls to limit a degree of pivoting of the basket relative to the basket frame.

20. The combination tilt-out and pick-off basket assembly according to claim 19, wherein the stop element projects from the bottom wall portion of the basket and into the track.

21. The combination tilt-out and pick-off basket assembly according to claim 20, wherein the stop element is located closer to the front wall portion than the back wall portion of the basket.

22. The combination tilt-out and pick-off basket assembly according to claim 21, wherein the basket constitutes a wire basket.

23. The combination tilt-out and pick-off basket assembly according to claim 13, further comprising: a pair of laterally spaced end guards projecting from the front wall portion toward the back wall portion of the basket.

* * * * *